US008008229B2

(12) United States Patent
Ikeda et al.

(10) Patent No.: US 8,008,229 B2
(45) Date of Patent: Aug. 30, 2011

(54) THERMOSENSITIVE RECORDING MATERIAL

(75) Inventors: Toshiaki Ikeda, Shizuoka (JP); Hiroaki Matsui, Shizuoka (JP); Yoshitaka Sano, Shizuoka (JP); Yoshiaki Matsunaga, Shizuoka (JP); Yuhei Fujimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/848,521

(22) Filed: Aug. 2, 2010

(65) Prior Publication Data

US 2011/0033642 A1 Feb. 10, 2011

(30) Foreign Application Priority Data

Aug. 5, 2009 (JP) ..... 2009-182488

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | |
|---|---|---|---|
| 7,425,522 | B2 | 9/2008 | Kadota et al. |
| 2003/0039917 | A1 | 2/2003 | Naruse et al. |
| 2007/0112113 | A1 | 5/2007 | Yamaguchi et al. |
| 2007/0184978 | A1 | 8/2007 | Takano et al. |
| 2007/0225164 | A1 | 9/2007 | Kajikawa et al. |
| 2008/0096762 | A1 | 4/2008 | Takano et al. |
| 2008/0280757 | A1 | 11/2008 | Matsunaga et al. |

FOREIGN PATENT DOCUMENTS

| | | | |
|---|---|---|---|
| EP | 1243439 | A1 | 9/2002 |
| EP | 1900542 | A1 | 3/2008 |
| JP | 2636895 | | 4/1997 |
| JP | 2812040 | | 8/1998 |
| JP | 2000-355165 | | 12/2000 |
| JP | 2002-127601 | * | 5/2002 |
| JP | 3520648 | | 2/2004 |
| JP | 3573833 | | 7/2004 |
| JP | 3611231 | | 10/2004 |
| JP | 2008-94092 | | 4/2008 |
| JP | 2008-260275 | | 10/2008 |

OTHER PUBLICATIONS

Sep. 23, 2010 European search report in connection with a counterpart European patent application No. 10171877.

* cited by examiner

*Primary Examiner* — Bruce H Hess
(74) *Attorney, Agent, or Firm* — Cooper & Dunham LLP

(57) ABSTRACT

To provide a thermosensitive recording material, which contains: a base; a thermosensitive coloring layer containing a leuco dye and a color developer; at least one protective layer containing a resin, a crosslinking agent, and wax, wherein the thermosensitive coloring layer is disposed on the base, and the protective layer is disposed on the thermosensitive coloring layer, and wherein the resin is reactive carbonyl group-containing polyvinyl alcohol, the crosslinking agent is a hydrazide compound, and the wax is oxidized polyethylene wax.

8 Claims, No Drawings

THERMOSENSITIVE RECORDING MATERIAL

BACKGROUND OF THE INVENTION

1. Field of the Invention

The present invention relates to a thermosensitive recording material for use in the fields of printers for computer output or calculator, recorders for medical instrumentation, low-speed or high speed printers, automatic ticket machines, thermosensitive copying, handy terminals, and labels such as POS system.

2. Description of the Related Art

Conventionally, various proposals have been made in a recording material having a thermosensitive recording layer, which contains as main components a colorless or pale color leuco dye and a color developer for coloring the leuco dye, disposed on a base of paper, synthesized paper, plastic film or the like, and which uses a coloring reaction initiated by applying heat, pressure, or the like to the thermosensitive recording layer. This type of the thermosensitive recording material has advantages such that complicated processes such as developing, fixing, and the like are not required, recording can be performed using a relatively simple device within a short period of time, less noise is made, and the required cost is low. Because of these advantages, such thermosensitive recording material is widely used. For example, it is used for copying books and documents, and is used as a recording material of electronic computers, facsimiles, ticket venders, label printers, recorders, and handy terminals.

As the thermosensitive recording material, those coloring in high density at high speed, and providing images and back ground of high fastness are desired.

Recently, many thermosensitive recording materials have been used in the field requiring reliability of recorded images, such as for labels and receipts. Accordingly, a thermosensitive recording material having high storage stability against water and acidic compounds contained in foods, or a plasticizer or oil and fats contained in an organic polymer material used in packaging is desired.

Moreover, in recent years, printing has been often performed by a printer of low torque, because of the trends for energy saving, or downsizing so as to use as a portable handy type of the printer. In this case, a thermosensitive recording material has a low head matching property, printing cannot be carried out in the low temperature and low humidity environment as the thermal head and the thermosensitive recording material stick to each other. Therefore, a high matching property between a thermal head and a surface of the thermosensitive recording material is required.

Conventionally, the aforementioned problems have been attempted to solve by adding a wax agent (i.e. a lubricant) to a protective layer disposed on the thermosensitive recording layer.

Use of zinc stearate and calcium stearate as the wax agent improves the head matching property, but calcium stearate does not provide a sufficient lubricating effect. Moreover, though zinc stearate gives a sufficient lubricating effect, it reduces the plasticizer resistance of the thermosensitive recording material. Furthermore, zinc, which is a main substance of zinc stearate, is regarded as a compound which possibly adversely affect water environment, and use of such material is not very suitable in recent years (see, for example, Japanese Patent (JP-B) No. 2812040).

By using montan wax (see, for example, JP-B No. 3611231) or carnauba wax (Japanese Patent Application Laid-Open (JP-A) No. 2000-355165) as the wax agent, the head-matching property is improved. However, as both wax use natural materials as a main substance, there is a possibility that a supply thereof is unstable depending on the change in the natural environment.

Moreover, there has been proposed a technique in which a lubricant having a melting point of 75° C. or lower is added to a protective layer (see, for example, JP-B No. 3573833). However, when the lubricant having a low melting point, such as 75° C. or lower is used in a protective layer, and a protective layer composite liquid is coated by a coating device and dried by a drier, the lubricant melts at the time of drying and then solidified again after the drying. In such case, the original lubricating function cannot be performed, and it is not suitable for mass-production.

Furthermore, more wax (i.e. a lubricant) has been used to solve sticking. The wax is formed of various raw materials, and various wax such as vegetable wax, animal wax, mineral wax, petroleum wax, and synthesis wax formed by chemical synthesis has been used.

Examples of the vegetable wax include carnauba wax, candelilla wax, rice wax, and castor oil. Examples of the animal wax include bees wax, and Chinese insect wax. Examples of the mineral wax include montan wax. Examples of the petroleum wax include paraffin wax, and microcrystalline wax. Examples of the synthesis wax include hydrocarbon-based synthesis wax such as polyethylene wax, and Fischer-Tropsch wax, and other synthesis wax such as higher fatty acid ester, fatty acid amide, ketones and amindes. Various wax has been developed as listed above.

As raw materials of the wax, other than the case of the synthesis wax, various materials present in nature have been used. These raw materials have a difficulty in stable supply due to the changes in the natural environment, or depletion of raw materials.

There has been a proposal such that a non-oxidized polyethylene wax is used as the wax (see JP-B No. 2636895). However, even with this non-oxidized polyethylene wax, a sufficient lubricating function cannot be attained.

Moreover, there has been a proposal such that oxidized polyethylene wax is used as the wax, and carboxy-modified polyvinyl alcohol is used as a resin of a protective layer, and a polyacrylamide epichlorohydrin-based crosslinking agent is used as a crosslinking agent for the protective layer (see, for example, JP-B No. 3520648). However, in this technique, sufficient conveying performance cannot be attained in the high temperature and high humidity environment. Therefore, desirable functions cannot be attained.

BRIEF SUMMARY OF THE INVENTION

The present invention aims at solving various problems in the art, and achieving the following object. Namely, an object of the present invention is to provide a thermosensitive recording material, which can be stably provided without being affected by the surrounding environment, and can improves anti-sticking property in high temperature and high humidity environment.

As a result of the diligent studies and researches conducted by the present inventors, the present inventors have come to the insight such that stable supplies are possible without being affected by the natural environment, and head-matching property, plasticizer resistance, water resistance, and conveying property at high temperature and high humidity can be improved with a desirable balance by providing a thermosensitive coloring layer, which contains a leuco dye and a color developer for coloring the leuco dye, and a protective layer on the thermosensitive coloring layer, using a reactive carboxyl group-containing polyvinyl alcohol as a resin for the protective layer, a hydrazine compound as a crosslinking layer, and oxidized polyethylene wax as wax (i.e. a lubricant) for the protective layer. The present invention is based upon the aforementioned insight of the present inventors.

Means for solving the aforementioned problems are as follows:

<1>A thermosensitive recording material, containing:

a base;

a thermosensitive coloring layer containing a leuco dye and a color developer;

at least one protective layer containing a resin, a crosslinking agent, and wax, wherein the thermosensitive coloring layer is disposed on the base, and the protective layer is disposed on the thermosensitive coloring layer, and wherein the resin is reactive carbonyl group-containing polyvinyl alcohol, the crosslinking agent is a hydrazide compound, and the wax is oxidized polyethylene wax.

<2>The thermosensitive recording material according to <1>, wherein the protective layer is formed using a protective layer composite liquid, which is a wax emulsion in which the oxidized polyethylene wax is emulsified and dispersed with assistance of an anionic emulsifying agent.

<3>The thermosensitive recording material according to <2>, wherein the oxidized polyethylene wax has an acid value of 10 mgKOH/g to 30 mgKOH/g.

<4>The thermosensitive recording material according to any one of <2> to <3>, wherein the oxidized polyethylene wax in the protective layer has a number average particle diameter of 0.3 μm to 2.0 μm.

<5>The thermosensitive recording material according to any one of <1> to <4>, wherein the oxidized polyethylene wax is contained in the protective layer in an amount of 5 parts by mass to 100 parts by mass relative to 100 parts by mass of the resin in the protective layer.

<6>The thermosensitive recording material according to any one of <1> to <5>, wherein the protective layer further contains silicone resin particles.

<7>The thermosensitive recording material according to any one of <1> to <6>, further containing:

an intermediate protective layer disposed between the thermosensitive coloring layer and the protective layer, wherein the thermosensitive coloring layer, the intermediate protective layer, and the protective layer are formed by simultaneously coating the layers by a curtain coating method.

<8>The thermosensitive recording material according to claim 7, wherein the intermediate protective layer contains a (meth)acrylic resin.

According to the present invention, various problems in the art can be solved, the aforementioned object can be achieved, and a thermosensitive recording material, which can be stably supplied without being affected by the natural environment, has the improved head-matching property, plasticizer resistance, water resistance, and conveying performance at high temperature and high humidity with desirable balance, can be provided.

DETAILED DESCRIPTION OF THE INVENTION

The present invention will be specifically explained hereinafter.

(Thermosensitive Recording Material)

The thermosensitive recording material of the present invention contains a base, a thermosensitive coloring layer, and a protective layer, and may further contain an intermediate protective layer, an undercoat layer, a back layer, and other layers, if necessary.

<Base>

The base is suitably selected depending on the intended purpose without any restriction regarding the shape, structure and size thereof. For example, the shape of the base is a plate shape or the like, the structure of the base may be a single layer structure or a laminate structure, and the size of the base is suitably selected depending on the size of the thermosensitive recording material.

A material of the base is suitably selected depending on the intended purpose without any restriction. Examples thereof include various inorganic materials and organic materials.

Examples of the inorganic materials include glass, quartz, silicon, silicon oxide, aluminum oxide, $SiO_2$, and metal.

Examples of the organic materials include: paper such as wood free paper, art paper, coated paper, synthesized paper, laminate paper, recycled pulp (containing 50% or more of recycled pulp); cellulose derivatives such as cellulose triacetate; and polymer films formed of a polyester resin such as polyethylene terephthalate (PET) and polybutylene terephthalate, or polymers such as polycarbonate, polystyrene, polymethyl methacrylate, polyethylene, and polypropylene. These may be used independently, or in combination.

Among them, wood free paper, art paper, coated paper and polymer paper are particularly preferable.

It is preferred that the base be surface-treated by corona discharge, oxidation reaction (with chromic acid and the like), etching, processing for improving adhesion, processing for antistatic, or the like for the purpose of improving the adhesion between the coating liquid and the base. Moreover, it is preferred that the base be colored in white by adding a white pigment such as titanium oxide and the like.

The thickness of the base is suitably selected depending on the intended purpose without any restriction, and is preferably 50 μm to 2,000 μm, more preferably 100 μm to 1,000 μm.

<Thermosensitive Coloring Layer>

The thermosensitive coloring layer is a layer formed on the base.

The thermosensitive coloring layer contains a leuco dye and a color developer, and may further contain other substances, if necessary.

—Leuco Dye—

The leuco dye for use in the present invention is an electron-donating compound, and is suitably selected depending on the intended purpose without any restriction provided that it is a colorless or light color dye precursor. Examples thereof include triphenylmethane phthalide compounds, triarylmethane compounds, fluoran compounds, phenothiazine compounds, thiofluoran compounds, xanthen compounds, indolyl phthalide compounds, auramine compounds, spiropyran compounds, azaphthalide compounds, indolino-phthalide compounds, chlormenopirazole compounds, methine compounds, rhodamine anilinolactum compounds, rhodamine lactum compounds, quinazoline compounds, diazaxanthen compounds, bislactone compounds and the like. These may be used independently or in combination.

The leuco dye is suitably selected depending on the intended purpose without any restriction. Examples thereof include 3,3-bis(p-dimethylaminophenyl)-phthalide, 3,3-bis(p-dimethylaminophenyl)-6-dimethyl-aminophthalide (i.e., crystal violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 2-anilino-3-methyl-6-(di-n-butylamino)fluoran, 3-cyclohexylamino-6-chlorofluoran, 3-dimethyl-amino-5,7-dimethyl-fluoran, 3-N-methyl-N-isobutyl-6-methyl-7-anilinofluoran, 3-N-ethyl-N-isoamyl-6-methyl-7-anilinofluoran, 3-diethylamino-7-chlorofluoran, 3-diethylamino-7-methylfluoran, 3-diethylamino-7,8-benzofluoran, 3-diethylamino-6-methyl-7-chlorofluoran, 3-(N-p-tolyl-N-ethylamino-)-6-methyl-7-anilinofluoran, 3-pyrrolidino-6-methyl-7-anilinofluoran, 2-{N-(3-trifluoromethyl-phenyl)amino}-1-6-diethylamino-fluoran, 2-{3,6-bis(diethylamino)-9-(o-chloroanilino)xantylic benzoic acid lactam}, 3-diethylamino-6-methyl-7-(m-trichloromethylanilino)fluoran, 3-diethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino-)fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl) -3-(2'-methoxy-5'-chlorophenyl)phthalide, 3-(2'-hydroxy-4'-dimethylaminophenyl) -3-(2'-methoxy-5'-nitrophenyl)phthalide, 3-(2'-hydroxy-4'-diethylaminophenyl) -3-(2'-methoxy-5'-methyl-phenyl)phthalide, 3-(2'-methoxy-4'-dimethyl-aminophenyl) -3-(2'-hydroxy-4'-chloro-5'-methyl-phenyl)phthalide, 3-morpholino-7-(N-propyl-trifluoromethylanilino)fluoran, 3-pyrrolidino-7-trifluoromethyl-anilinofluoran, 3-diethylamino-5-chloro-7-(N-benzyltrifluoromethyl-anilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-methyl-Nisopropylamino-)-6-methyl-7-anilinofluoran, 3-dibutylamino-6-methyl-7-anilinofluoran, 3-diethylamino-6-ethyl-7-(3-methylanilino)fluoran, 3,6-bis(dimethylamino)fluorine spiro (9,3')-6'-dimethylaminophthalide, 3-(N-benzyl-N-cyclohexylamino)-5,6-benzo-7-α-naphthylamino -4'-bromofluoran, 3-diethylamino-6-chloro-7-anilinofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzofluoran, 3-(p-dimethylaminophenyl)-3-{1,1-bis(p-dimethylaminophenyl)ethylen-2-yl}phthalide, 3-(p-dimethylaminophenyl)-3-{1,1-bis(p-dimethylaminophenyl)ethylen-2-yl}-6-dimethylaminophthalide, 3-(p-dimethylaminophenyl)-3-(1-p-dimethylaminophenyl-1-phenylethylen n-2-yl)phthalide, 3-(p-dimethylaminophenyl)-3-(1-p-dimethylaminophenyl-1-p-chlorophenylethylen Ylethylen-2-yl)-6-dimethylaminophthalide, 3-(4'-dimethylamino-2'-methoxy)-3-(1"-p-dimethylaminophenyl-1"-p-chlo Rophenyl1",3"-butadien-4"-yl)benzophthalide, 3-(4'-dimethyl-amino-2'-benzyloxy)-3-(1"-p-dimethyl-amino-phenyl-1"-ph enyl-1",3"-butadien)yl}benzophthalide, 3-dimethylamino-6-dimethylaminofluorene-9-spiro -3'(6'-dimethyl-amino-)phthalide, 3,3-bis12-(p-dimethylaminophenyl)-2-(p-methoxyphenyl)ethenyl-1-4,5,6, 7-tetrachlorophthalide, 3-bis{1,1-bis(4-pyrrolidinophenyl)ethylen-2-yl}-5,6-dichloro-4,7-dibromophthalide, bis(p-dimethylaminostyryl)-1-naphthalene sulfonyl methane, bis(p-dimethylaminostyryl) 4-p-tolyl sulfonyl methane, 3-dibutylamino-6-methyl-7-anilinofluoran, 3-di(n-pentyl)amino-6-methyl-7-anilinofluoran, and 3-(N-ethyl-N-p-toluidino)-6-methyl-7-anilinofluoran.

The amount of the leuco dye contained in the thermosensitive coloring layer is suitably selected depending on the intended purpose without any restriction, but it is preferably 5% by mass to 20% by mass, more preferably 10% by mass to 15% by mass.

—Color Developer—

The color developer is selected from various electron-accepting compounds, oxidant, phenol compounds, organic or inorganic acid compounds, esters thereof and salts thereof, which color the leuco dye at the time when they are made in contact (heated).

The color developer is suitably selected depending on the intended purpose without any restriction. Examples thereof include 4,4'-isopropylidene bisphenol, 4,4'-isopropylidene bis(o-methylphenol), 4,4'-sec-butylidene bisphenol, 4,4'-isopropylidene bis(2-tert-butylphenol), znc p-nitro benzoate, 1,3,5-tris(4-ter-butyl-3-hydroxy-2,6-dimethylbenzyl)isocyanurate, 2,2-(3,4'-dihydroxydiphenyl)propane, bis(4-hydroxy-3-methylphenyl)sulfide, 4-{β-(p-methoxyphenoxy)ethoxy}salicylate, 1,7-bis(4-hydroxyphenylthio)-3,5-dioxahepane, 1,5-bis(4-hydroxyphenylthio)-5-oxapentane, monocalcium monobenzyl phthalate, 4,4'-cyclohexylidene diphenol, 4,4'-isopropylidenebis(2-chlorophenol), 2,2'-methylene bis(4-methyl-6-tert-butylphenol), 4,4'-butylidene bis(6-tert-butyl-2-methyl)phenol, 1,1,3-tris (2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methyl)phenol, 4,4'-diphenyl sulfone, 4-isopropoxy-4'-hydroxydiphenylsulfone, 4-benzyloxy-4'-hydroxydiphenylsulfone, 4,4'-diphenol sulfoxide, isopropyl p-hydroxyl benzoate, benzyl p-hydroxyl benzoate, benzyl 3,4-dihydroxybenzoate (i.e. benzyl protocatechuic acid), stearyl gallate, lauryl gallate, octyl gallate, 1,3-bis(4-hydroxyphenylthio)-propane, N,N'-diphenyl thiourea, N,N'-di(m-chlorophenyl)thiourea, salicylanilide, methyl bis(4-hydroxyphenyl) acetate, benzyl bis(4-hydroxyphenyl) accetate, 1,3-bis(4-hydroxycumyl)benzene, 1,4-bis(4-hydroxycumyl) benzene, 2,4'-diphenol sulfone, 2,2'-diallyl-4,4'-diphenol sulfone, 3,4-dihydroxyphenyl-4'-methyldiphenyl sulfone, zinc 1-acetyloxy-2-naphthoate, zinc 2-acetyloxy-1-naphthoate, zinc 2-acetyloxy-3-naphthoate, α,α-bis(4-hydroxyphenyl)-α-methyl toluene, antipyrine complex of zinc thiocyanate, tetrabromo bisphenol A, tetrabromo bisphenol S, 4,4'-thiobis(2-methylphenol), 4,4'-thiobis(2-chlorophenol), bis(4-hydroxyphenyl) sulfone-monoallyl ether, 4,4'[oxybis (ethyleneoxy-P-phenylenesulfonyl)]diphenol, 2,4'-dihydroxydiphenyl sulfone, and 4-hydroxy-4'-isopropoxydiphenyl sulfone. These may be used independently, or in combination.

A mass ratio of the leuco dye contained in the thermosensitive coloring layer to the color developer contained therein is suitably selected depending on the intended purpose without any restriction, but it is preferably such that the color developer is preferably 1 part by mass to 20 parts by mass, more preferably 2 parts by mass to 10 parts by mass, relative to 1 part by mass of the coloring agent (leuco dye).

—Other Substances—

The thermosensitive coloring layer may contain, as the aforementioned other substances, a binder, filler, a thermoplastic material, a hindered phenol compound and hindered amine compound, a crosslinking agent, a pigment, a surfactant, a fluorescent whitening agent and a lubricant.

—Binder—

The binder may be used as necessary in order to improve the adhesiveness and coatability of the layer.

The binder resin is suitably selected depending on the intended purpose without any restriction. Specific examples thereof include starches, hydroxyethyl cellulose, methyl cellulose, carboxy methyl cellulose, gelatin, casein, gum arabic, polyvinyl alcohols, salts of diisobutylene/maleic anhydride copolymers, salts of styrene/maleic anhydride copolymers, salts of ethylene/acrylic acid copolymers, salts of styrene/acryl copolymers and emulsion salts of styrene/butadiene copolymers.

—Filler—

The filler is suitably selected depending on the intended purpose without any restriction. Examples thereof include inorganic pigments such as calcium carbonate, aluminum oxide, zinc oxide, titanium dioxide, silica, aluminum hydroxide, barium sulfate, talc, kaolin, alumina and clay, and commonly known organic pigments. Among them, acidic pigments (those exhibiting acidity in aqueous solutions) such as silica, alumina and kaolin are preferable in terms of their water proof property, and silica is more preferable in terms of color density in a resulting developed image.

—Thermoplastic Material—

In the present invention, various thermoplastic materials may be added depending on the intended purpose (e.g. as a sensitizer). In the case where the thermosensitive recording material is used on packages of prepared foods or the like and the heat resistance thereof is required, the thermoplastic material may not be added, or it is selected from compounds having a melting point of 100° C. or higher.

The thermoplastic material is suitably selected depending on the intended purpose without any restriction. Examples thereof include: fatty acids such as stearic acid, and behenic acid; fatty acid amides such as stearic acid amide, and palmitic acid amide; fatty acid metal salts such as zinc stearate, aluminum stearate, calcium stearate, zinc palmitate, and zinc behenate; and others such as p-benzylbiphenyl, m-terphenyl, p-acetylbiphenyl, triphenyl methane, benzyl p-benzyloxy benzoate, β-benzyloxy naphthalene, phenyl β-naphthoate, phenyl 1-hydroxy-2-naphthoate, methyl 1-hydroxy-2-naphthoate, diphenyl carbonate, glycol carbonate, dibenzyl terephthalate, dimethyl terephthalate, 1,4-dimethoxy naphthalene, 1,4-diethoxy naphthalene, 1,4-dibenzoxy naphthalene, 1,2-diphenoxy ethane, 1,2-bis(3-methylphenoxy) ethane, 1,2-bis(4-methylphenoxy)ethane, 1,4-diphenoxy-2-butene, 1,2-bis(4-methoxyphenylthio)ethane, dibenzoyl methane, 1,4-diphenylthiobutane, 1,4-diphenylthio-2-butene, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, dibenzoyloxypropane, dibenzyl disulfide, 1,1-diphenyl ethanol, 1,1-diphenyl propanol, p-benzyloxy benzyl alcohol, 1,3-phenoxy-2-propanol, N-octadecylcarbamyl-p-methoxycarbonyl benzene, N-octadecyl carbamoyl benzene, 1,2-bis(4-methoxyphenoxy)propane, 1,5-bis(4-methoxyphenoxy)-3-oxapentane, 1,2-bis(3,4-dimethylphenyl)ethane, dibenzyl oxalate, bis(4-methylbenzyl) oxalate, bis(4-chlorobenzyl)oxalate, and 4,4'-diallyloxydiphenyl sulfone.

—Hindered Phenol Compound and Hindered Amine Compound—

To the thermosensitive coloring layer, if necessary, various hindered phenol compounds and hindered amine compounds, which are electron-accepting compounds but have relatively low coloring ability, may be added as an auxiliary additive. Specific examples thereof will be shown below.

The hindered phenol compound and hindered amine compound are suitably selected depending on the intended purpose without any restriction. Examples thereof include 2,2'-methylenebis(4-ethyl-6-tert-butylphenol), 4,4'-butylidenebis (6-tert-butyl-2-methylphenol), 1,1,3-tris(2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methylphenol), tetrabromobisphenol A, tetrabromobisphenol S, 4,4-thiobis(2-methylphenol), 4,4'-thiobis(2-chlorophenol), tetrakis (1,2,2,6,6-pentamethyl-4-piperidyl)-1,2,3,4-butanetetracarboxylate, and tetrakis(1,2,2,6,6-tetramethyl-4-piperidyl) -1,2,3,4-butanetetracarboxylate.

—Fluorescent Whitening Agent—

The fluorescent whitening agent is used for whitening the background area as well as improving appearances.

The fluorescent whitening agent is suitably selected depending on the intended purpose without any restriction, but it is preferably a diaminostilbene compound in view of the obtainable effect of whitening background, and stability of a protective layer composite liquid.

Further, when N-aminopolyacryl amide serving as a crosslinking agent is added to the protective layer, or both the thermosensitive recording layer and the protective layer, diacetone-modified polyvinyl alcohol preferably is added into the thermosensitive recording layer. This is because a crosslinking reaction readily occurs, and waterproof property can be improved without adding another crosslinking agent that could impede color formation.

The method for forming the thermosensitive coloring layer is suitably selected depending on the intended purpose without any restriction. For example, the following method is used to form the thermosensitive coloring layer. The leuco dye and developer have been pulverized and dispersed together with the binder and the other components so as to be a particle diameter of 1 μm to 3 μm by a disperser such as a ball mill, Atriter and sand mill. The resultant dispersion is mixed, if necessary, together with the filler and the hot-melt material (sensitizer) dispersion liquid in accordance with a predetermined formulation, to thereby prepare a thermosensitive coloring layer-coating liquid. Subsequently, the thus-prepared coating liquid is applied onto the base.

The thickness of the thermosensitive coloring layer is suitably selected depending on materials used in the thermosensitive coloring layer, intended use of the thermosensitive recording material and the like, without any restriction. The thickness thereof is preferably 1 μm to 50 μm, more preferably 3 μm to 20 μm.

<Protective Layer>

The protective layer is a layer formed on the thermosensitive coloring layer.

The protective layer contains a resin, a crosslinking agent, and wax (i.e., a lubricant), and may further contain filler and other substances, if necessary.

—Resin—

The resin is suitably selected depending on the intended purpose without any restriction, provided that it is polyvinyl alcohol containing a reactive carbonyl group(s).

The polyvinyl alcohol containing a reactive carbonyl group (s) is suitably selected depending on the intended purpose without any restriction, and examples thereof include diacetone-modified polyvinyl alcohol.

The polyvinyl alcohol containing a reactive carbonyl group (s) can be produced by the conventional methods, such as a method in which vinyl monomers each containing a reactive carbonyl group(s) and fatty acid vinyl ester are copolymerized.

The vinyl monomer containing a reactive group(s) is suitably selected depending on the intended purpose without any restriction. Examples thereof include monomers containing groups including ester bonds, and monomers containing acetone groups.

Among them, a vinyl monomer containing a diacetone group is preferable, and specifically, diacetone acryl amide, and methadiacetone acryl amide are preferable. As a structural example of a polymer having such residue, the modified PVA is listed below.

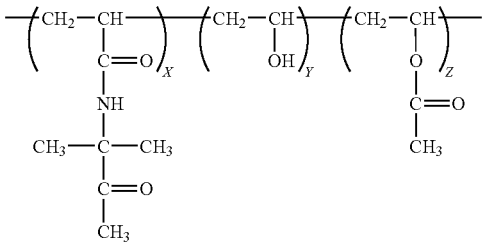

In the above formula, X, Y, and Z are each independently an integer of 0 or larger.

To obtain the aforementioned diacetone-modified polyvinyl alcohol, diacetone acryl amide, methadiacetone acryl amide and the like are used.

The fatty acid vinyl ester is suitably selected depending on the intended purpose without any restriction. Examples thereof include vinyl formate, vinyl acetate, and vinyl propionate.

Among them, vinyl acetate is preferable.

The diacetone-modified polyvinyl alcohol may be copolymerized with vinyl monomers.

The vinyl monomer capable of copolymerizing such diacetone-modified polyvinyl alcohol is suitably selected depending on the intended purpose without any restriction. Examples thereof include acrylic acid ester, butadiene, ethylene, propylene, acrylic acid, methacrylic acid, maleic acid, maleic anhydride, and itaconic acid.

The amount of the diacetone group contained in the diacetone-modified polyvinyl alcohol is suitably selected depending on the intended purpose without any restriction, but it is generally about 0.5 mol % to about 20 mol % relative to the total amount of the polymer, and is preferably 2 mol % to 10 mol % for improving water resistance of a resulting thermosensitive recording material. When the amount thereof is less than 2 mol %, the water resistance thereof is insufficient for practical use. When the amount thereof is more than 10 mol %, the water resistance thereof does not improve further, but the production cost increases.

The polymerization degree of the diacetone-modified polyvinyl alcohol is suitably selected depending on the intended purpose without any restriction, but it is preferably 300 to 3,000, more preferably 500 to 2,200.

The saponification degree of the diacetone-modified polyvinyl alcohol is preferably 80% or more.

—Crosslinking Agent—

The crosslinking agent is suitably selected depending on the intended purpose without any restriction, provided that it contains a hydrazide compound.

The hydrazide compound is suitably selected depending on the intended purpose without any restriction. Examples thereof include dihydrazide compounds such as adipic dihydrazide, and phthalic dihydrazide.

Moreover, one or more crosslinking agents mentioned above may be used in combination with one or more crosslinking agents known in the art.

—Wax—

The wax is suitably selected depending on the intended purpose without any restriction, provided that it is oxidized polyethylene wax.

The oxidized polyethylene wax contains at least either of oxidized polyethylene or acid-modified polyethylene, and either of them provides the same effect.

A synthesis method of the oxidized polyethylene wax is suitably selected depending on the intended purpose without any restriction. Examples thereof include a method for polymerizing ethylene, a method for decomposing polyethylene, and the like.

A polymerization method for polymerizing ethylene is suitably selected depending on the intended purpose without any restriction. Examples thereof include a method in which ethylene monomers and olefin oxide are copolymerized, a method in which non-oxidized olefin monomers and olefin oxide are copolymerized, an oxidization method, and the like.

The monomer for use in the copolymerization is suitably selected depending on the intended purpose without any restriction in terms of the monomer for use, number of monomers for use, and polymerization degrees.

The oxidization method is suitably selected depending on the intended purpose without any restriction. Examples thereof include a method in which oxidization is carried out after polymerization, and a method in which oxidized monomers are copolymerized. Moreover, a catalyst for use in the polymerization is suitably selected depending on the intended purpose without any restriction.

At the time when the oxidized polyethylene wax is applied to a thermosensitive material, it is difficult to directly apply the oxidized polyethylene wax to the thermosensitive material, and thus it is preferable that a dispersion liquid of the oxidized polyethylene wax in which the oxidized polyethylene wax is dispersed with assistance of a dispersing agent in wet system is used.

Here, the embodiment of the dispersion liquid is suitably selected depending on the intended purpose without any restriction. Examples thereof include (i) an aqueous dispersion liquid in which the oxidized polyethylene wax is dispersed in water with assistance of polyvinyl alcohol serving as a dispersing agent, and (ii) an emulsion in which the oxidized polyethylene wax is emulsified and dispersed with assistance of an anionic emulsifying agent.

The anionic emulsifying agent is suitably selected depending on the intended purpose without any restriction. Examples thereof include a sulfonic acid-based emulsifying agent, and a carboxylic acid-based emulsifying agent. Note that, although it is possible to disperse the oxidized polyethylene wax with assistance of a nonionic emulsifying agent, use of a lubricant using the anionic emulsifying agent in the thermosensitive material increases water resistance of the resulting thermosensitive recording material after image printing higher than the case where the nonionic emulsifying agent is used, and produces a thermosensitive recording material of higher quality.

The melting point of the oxidized polyethylene wax, which is added to a protective layer coating liquid for forming the aforementioned protective layer, is suitably selected depending on the intended purpose without any restriction, but it is preferably 90° C. to 120° C. When the lubricant having a low melting point is used in the protective layer composite liquid, and such liquid is coated by a coating device and dried by a dryer, the lubricant melts at the time of drying and then solidified again after the drying. In such case, the original lubricating function cannot be performed, and it is not suitable for mass-production.

The acid value of the oxidized polyethylene wax, which is added to a protective layer coating liquid for forming the aforementioned protective layer, is suitably selected depending on the intended purpose without any restriction, but it is preferably 10 mgKOH/g to 30 mgKOH/g. The acid value is expressed by a weight (mg) of potassium hydroxide required to neutralize acid substances contained in 1 g of a sample. Specifically, it can be measured in accordance with the method specified in JIS K 2501.

When the acid value of the oxidized polyethylene wax is less than 10 mgKOH/g, a number of acid groups small, and thus sufficient stickiness cannot be attained. When the acid value thereof is more than 30 mgKOH/g, though lubricity can be attained, it is difficult to form the oxidized polyethylene wax into emulsion, and thus it is not desirable for mass production.

A number average particle diameter of the oxidized polyethylene wax, which is added to a protective layer coating liquid for forming the aforementioned protective layer, is suitably selected depending on the intended purpose without any restriction, but it is preferably 0.3 μm to 2.0 μm. When the number average particle diameter thereof is less than 0.3 μm, it is difficult to generate the oxidized polyethylene wax dispersion particles, which is hence not suitable for mass-production, and stickiness thereof reduces. When the number average particle diameter thereof is more than 2.0 μm, resistance to a plasticizing agent reduces.

An amount of the oxidized polyethylene wax contained in the protective layer is suitably selected depending on the intended purpose without any restriction, but it is preferably 5 parts by mass to 100 parts by mass, more preferably 10 parts by mass to 50 parts by mass relative to 100 parts by mass of the resin contained in the protective layer. When the amount of the oxidized polyethylene wax is less than 5 parts by mass, a sufficient effect of stickiness cannot be attained. When the amount thereof is more than 100 parts by mass, resistance to a plasticizing agent is insufficient.

—Filler—

The filler is suitably selected depending on the intended purpose without any restriction. Examples thereof include: inorganic powders such as aluminum hydroxide, calcium carbonate, silica, zinc oxide, titanium oxide, zinc hydroxide, barium sulfate, clay, talc, surface-treated calcium, and surface-treated silica; and organic powders such as silicone resin particles, urea-formalin resin, styrene-methacrylic acid copolymer, and a polystyrene resin.

Among them, aluminum hydroxide and calcium carbonate are preferable because they provide the thermosensitive recording material with excellent abrasion resistance against a thermal head when the thermosensitive recording material is used for printing for a long period of time.

<Intermediate Protective Layer>

The intermediate protective layer is a layer formed between the thermosensitive coloring layer and the protective layer.

The intermediate protective layer contains a resin and a crosslinking agent, and may further contain other substances, if necessary.

—Resin—

The resin is suitably selected depending on the intended purpose without any restriction. For example, (meth)acrylic resins can be used as the resin.

The (meth)acrylic resin is suitably selected depending on the intended purpose without any restriction, and may be selected from those suitably synthesized or commercial products. Preferable examples thereof include a monopolymer formed by polymerizing either of (meth)acrylic acid or (meth)acrylic acid ester, and a copolymer formed by copolymerizing (meth)acrylic acid and/or (meth)acrylic acid ester, and a vinyl monomer capable of copolymerizing (meth) acrylic acid and/or (meth)acrylic acid ester, such as styrene.

The (meth)acrylic acid ester is suitably selected depending on the intended purpose without any restriction. Examples thereof include monomers and oligomers generally used for an ultraviolet curing resin or electron-beam curing resin.

Among them those having flexible structures are preferable, and aliphatic compounds are more preferable.

Note that, among the aliphatic compound, aromatic compounds having chain structures are preferable. Moreover, monofunctional monomers and bifunctional monomers are preferable to polyfunctioanl monomers, that are tri- or higher functional monomers.

The (meth)acrylate is suitably selected depending on the intended purpose without any restriction. Examples thereof include alkyl(meth)acrylate having an alkyl group, amino (meth)acrylate having an alkyl group, glycol (meth)acrylate, allyl(meth)acrylate, trimethylolpropane tri(meth)acrylate, glycidyl(meth)acrylate, acryl amide, diacetone acrylamide, (meth) acrylonitrile, benzyl(meth)acrylate, dimethylaminoethyl(metWacrylate methyl chloride salt, trimethylolpropane tri(meth)acrylate, and glycidyl(meth)acrylate. These may be used independently or in combination.

The alkyl(meth)acrylate having an alkyl group is suitably selected depending on the intended purpose without any restriction, but those having a C1-18 alkyl group are preferable, and those having a C3-15 alkyl group are more preferable. Specific examples thereof include methyl(meth)acrylate, ethyl(meth)acrylate, n-butyl(meth)acrylate, i-butyl (meth)acrylate, cyclohexyl(meth)acrylate, 2-ethylhexyl (metWacrylate, lauryl(meth)acrylate, stearyl(meth)acrylate, amino(meth)acrylate, and glycol di(meth)acrylate.

When the number of carbon atoms contained in the alkyl group is excessively small, the resulting (meth)acrylic resin may not have sufficient flexibility. When the number of carbon atoms is too large, methylene chains present as side chains may align regularly, which leads lack of flexibility in the resulting (meth)acrylic resin.

The amino(meth)acrylate containing an alkyl group is suitably selected depending on the intended purpose without any restriction, but those having a C1-5 alkyl group are preferable. Specific examples thereof include dimethylaminoethyl (meth)acrylic acid ester, and dimethylaminoethyl(meth) acrylic acid ester.

The glycol di(meth)acrylate is suitably selected depending on the intended purpose without any restriction. Examples thereof include ethylene glycol di(meth)acrylate, and butylene glycol di(meth)acrylate.

The vinyl monomer capable of copolymerizing is suitably selected depending on the intended purpose without any restriction. Examples thereof include: vinyl arenas such as styrene, α-methylstyrene, monochlorostyrene, and dichlorostyrene; vinyl cyanes such as acrylonitrile, and methacylonitrile; halogenated vinyls such as vinyl chloride, vinyl bromide, and chloroprene; alkens such as vinyl acetate; halogenated alkenes such as ethylene, propylene, butylene, butadiene, and isobutylene; polyfunctional monomers such as allylmethacrylate, diallylphthalate, triallylcyanurate, monoethyleneglycol dimethacrylate, tetraethyleneglycol diacrylate, tetraethyleneglycol dimethacrylate, divinyl benzene, and glycidyl methacrylate. These may be used independently or in combination.

Among them, acrylic resins containing ethyl acrylate, butyl acrylate, and/or hexyl-2-ethyl acrylate as copolymerizing components, or acrylic resins obtained by copolymerizing the aforementioned components with copolymerizing components such as methacrylic acid ester, styrene, and vinyl acetate. In view of binding ability with the resin contained in an aqueous flexo ink, a styrene-acrylic acid copolymer is more preferable.

In the case where an acrylic resin emulsion is used as the (meth)acrylic resin, barrier properties such as plasticizer resistance and oil resistance reduces. Therefore, use of an aqueous solution thereof is more preferable over the emulsion.

An amount of the (meth)acrylic resin contained in the intermediate protective layer is suitably selected depending on the intended purpose without any restriction, but it is preferably 1 part by mass to 50 parts by mass, more preferably 5 parts by mass to 30 parts by mass relative to 100 parts by mass of the diacetone-modified polyvinyl alcohol resin.

When the amount thereof is less than 1 part by mass, water resistance thereof may not be obtained against images printed with an aqueous flexo ink. When the amount thereof is more than 50 parts by mass, antisticking property may degrades in low temperature and low humidity environment.

An acid value of the (meth)acrylic resin is suitably selected depending on the intended purpose without any restriction, but it is preferably 100 mgKOH/g or more, more preferably 150 mgKOH/g to 250 mgKOH/g.

When the acid value thereof is less than 100 mgKOH/g, sufficient water resistance to images printed with an aqueous flexo ink may not be attained.

The acid value of the (meth)acrylic resin can be measured, for example, by a method as defined in JIS K0070.

The mass average molecular weight of the (meth)acrylic resin is suitably adjusted depending on the intended purpose without any restriction, but is preferably 1,000 to 300,000.

Besides the aforementioned (meth)acrylic resin, a resin for use in the intermediate protective layer is suitably selected depending on the intended purpose without any restriction. Examples thereof include: polyvinyl alcohol; cellulose derivatives starch and derivatives thereof, methoxycellulose, hydroxyethyl cellulose, and carboxymethyl cellulose; polyacrylate soda; polyvinyl pyrrolidone, alkali salts of styrene-maleic anhydride copolymer; alkali salts of isobutylene-maleic anhydride copolymer; water-soluble polymers such as polyacryl amide, gelatine, and casein.

Among them, polyvinyl alcohol having a reactive carbonyl group is preferable, and itaconic acid-modified polyvinyl alcohol and diacetone-modified polyvinyl alcohol are more preferable, because they are not easily dissolved or soften with heat, has high heat resistance, and are advantageous for improving the antisticking property.

—Crosslinking Agent—

The crosslinking agent is suitably selected depending on the intended purpose without any restriction. Examples thereof include: a polyvalent amine compound such as ethylene diamine; a polyvalent aldehyde compound such as glyoxal, glutaraldehyde, and dialdehyde; a dihydrazide compound such as adipic dihydrazide, and phthalic dihydrazide; a water-soluble methylol compound (e.g. urea, melamine, phenol); a polyfunctional epoxy compound; a polyvalent metal salt (e.g. Al, Ti, Zr, and Mg as a metal for use); titanium lactate; and boric acid. Moreover, these may be used in combination with other conventional crosslinking agents.

<<Curtain Coating Method>>

The thermosensitive coloring layer, the protective layer, and the intermediate protective layer are preferably formed by simultaneously applying coating liquids thereof by a curtain coating method. By using this method, a number of processes, and cost required for the installation of equipments reduces, and multiple layers can be easily formed where each layer is functionally separated.

A viscosity (B type viscometer, at 25° C.) of the coating liquid for used in the curtain coating is suitably selected depending on the intended purpose without any restriction, but it is preferably 100 mPa·s to 500 mPa·s, more preferably 150 mPa·s to 400 mPa·s.

When the viscosity of the coating liquid is lower than 100 mPa·s, coating liquids for use are mixed to each other, which lowers a sensitivity of the resulting thermosensitive recording material. When the viscosity thereof is higher than 500 mPa·s, the flow rate differs between the flow adjacent to an edge guide of a curtain nozzle and the center part of the flow, and thus the deposition amount of the edge portion of the coated layer increases, which causes rising.

The thermosensitive recording material may contain an undercoat layer between the base and the thermosensitive coloring layer, an additional protective layer between the thermosensitive coloring layer and the protective layer for improving the image reliability, and/or a back layer disposed on the back surface of the base.

<Undercoat Layer>

The undercoat layer is a layer formed between the base and the thermosensitive coloring layer.

The undercoat layer contains a binder resin and hollow plastic particles, and may further contain other substances, if necessary.

—Hollow Plastic Particles—

The hollow plastic particles are fine hollow particles each containing a thermoplastic resin as a shell, and air or other gas in the inner part thereof, and are already in the foamed state.

The average particle diameter (outer diameter) of the hollow plastic particles is suitably selected depending on the intended purpose without any restriction, but it is preferably 0.2 μm to 20 μm, more preferably 2 μm to 5 μm.

When the average particle diameter is less than 0.2 μm, it is technically difficult to make particles hollow and the function of the under layer becomes insufficient. On the other hand, when the above diameter is more than 20 μm, the dried coating surface degrades in smoothness. Thus, the coated thermosensitive recording layer becomes non-uniform, and it is required to apply larger amount of thermosensitive recording layer coating liquid than necessary in order to provide a uniform layer.

Accordingly, the hollow plastic particles preferably have a sharp distribution peak with little variation as well as an average particle diameter falling within the aforementioned range.

The hollow ratio of the hollow plastic particles is suitably selected depending on the intended purpose without any restriction, but it is preferably 30% to 95%, particularly preferably 80% to 95%.

When the hollow ratio thereof is less than 30%, thermal insulating properties are insufficient. Thus, heat energy from the thermal head is emitted to the outside of the thermosensitive recording material via the support, resulting in that the effect of improving sensitivity becomes inadequate. The hollow ratio referred to herein is the ratio of the inner diameter (the diameter of the hollow part) of the hollow particles to the outer diameter, and can be expressed by the following equation:

$$\text{Hollow ratio (\%)} = (\text{inner diameter of the hollow particles}/\text{outer diameter of the hollow particles}) \times 100$$

As described above, each of the hollow plastic particles has a shell of thermoplastic resin. Such thermoplastic resin is suitably selected depending on the intended purpose without any restriction. Examples of the thermoplastic resin include styrene-acrylic resins, polystyrene resins, acrylic resins, polyethylene resins, polypropylene resins, polyacetal resins, chlorinated polyether resins, vinyl polychloride resins, and copolymer resins whose main components are vinylidene chloride and acrylonitrile. Among them, styrene-acrylic resins, and copolymer resins whose main components are vinylidene chloride and acrylonitrile are preferable, because they have high void ratios, have less variation in the particle diameters, and are suitable for blade coating.

The thermoplastic material is suitably selected depending on the intended purpose without any restriction. Examples thereof include phenol-formaldehyde resins, urea-formaldehyde resins, melamine-formaldehyde resins, furan resins, unsaturated polyester resins produced through addition polymerization, and crosslinked MMA resins.

A coating amount of the hollow plastic particles is suitably selected depending on the intended purpose without any restriction, but it needs to be 1 g to 3 g relative to 1 $m^2$ of the base, for maintaining sensitivity and coating uniformity. When the coating amount thereof is less than 1 $g/m^2$, sufficient sensitivity cannot be attained. When the coating amount thereof is more than 3 $g/m^2$, the binding force of the layer decreases.

<Back Layer>

The thermosensitive recording material of the present invention preferably contains a back layer, which contains a pigment, a water-soluble resin (binder resin), and a crosslinking agent, disposed on the face (back surface) opposite to the face of the base where the thermosensitive coloring layer is disposed.

The back layer may further contain other substances such as filler, and wax (lubricant).

—Binder Resin—

The binder resin is suitably selected depending on the intended purpose without any restriction, provided that it is either a water-dispersible resin or a water-soluble resin. Examples thereof include a water-soluble polymer, and an aqueous polymer emulsion.

The water-soluble polymer is suitably selected depending on the intended purpose without any restriction. Examples thereof include: polyvinyl alcohol; starch and derivatives thereof cellulose derivatives such as methoxy cellulose, hydroxyethyl cellulose, carboxymethyl cellulose, methyl cellulose, and ethyl cellulose; polyacrylate soda; polyvinyl pyrrolidone; acryl amide-acrylic acid ester copolymers; acryl amide-acrylic acid ester-methacrylic acid terpolymers; alkali salts of styrene-maleic anhydride copolymers; alkali salts of isobutylene-maleic anhydride copolymers; polyacryl amide; alginate soda, gelatin and casein. These may be used independently or in combination.

The aqueous polymer emulsion is suitably selected depending on the intended purpose without any restriction. Examples thereof include: latexes of acrylate copolymers, styrene-butadiene copolymers and styrene-butadiene-acryl copolymers; and emulsions of a vinyl acetate resin, vinyl acetate-acrylate copolymers, styrene-acrylate copolymers, acrylate resins and polyurethane resins. These may be used independently or in combination.

—Crosslinking Agent—

As the crosslinking agent, those used in the intermediate protective layer can be used.

—Filler—

As the filler, inorganic filler or organic filler can be used.

The inorganic filler is suitably selected depending on the intended purpose without any restriction. Examples thereof include carbonates, silicates, metal oxides and sulfate compounds.

The organic filler is suitably selected depending on the intended purpose without any restriction. Examples thereof include a silicone resin, a cellulose resin, an epoxy resin, a nylon resin, a phenol resin, a polyurethane resin, a urea resin, a melamine resin, a polyester resin, a polycarbonate resin, a styrene-based resin, an acrylic resin, a polyethylene-based resin, a formaldehyde-based resin, and a polymethyl methacrylate resin.

A method for forming the back layer is suitably selected depending on the intended purpose without any restriction, but it is preferably the method in which a back layer coating liquid is coated on the base to form the back layer.

The coating method is suitably selected depending on the intended purpose without any restriction. Examples thereof include spin coating, dip coating, kneader coating, curtain coating, and blade coating.

The thickness of the back layer is suitably selected depending on the intended purpose without any restriction, but it is preferably 0.1 μm to 10 μm, more preferably 0.5 μm to 5 μm.

As for a thermosensitive recording label that is one application example of the thermosensitive recording material, a first embodiment of the thermosensitive recording label has an adhesive layer and a release paper which are successively laminated on a back surface of the base or on the surface of the back layer of the thermosensitive recording material, and may have other structure, if necessary.

The thermosensitive recording material having an adhesive layer is obtained by applying an adhesive on the back surface of the thermosensitive recording material of the present invention and laminating a release paper thereon. As a result, the thermosensitive recording material can be used for POS labels, or labels used for physical distribution, and thus a range of applications thereof increases.

The materials for the adhesive layer can be appropriately selected in accordance with the intended purpose, and examples thereof include urea resins, melamine resins, phenol resins, epoxy resins, vinyl acetate resins, vinyl acetate/acrylic copolymers, ethylene/vinyl acetate copolymers, acrylic resins, polyvinyl ether resins, vinyl chloride/vinyl acetate copolymers, polystyrene resins, polyester resins, polyurethane resins, polyamide resins, chlorinated polyolefin resins, polyvinyl butyral resins, acrylate copolymers, methacrylate copolymers, natural rubber, cyanoacrylate resins and silicone resins. These may be used independently or in combination.

As a second embodiment of the thermosensitive recording label has a thermosensitive adhesive layer which develops adhesion by the action of heat and which is laid over the back layer or the back surface of the base of the thermosensitive recording material, and, if necessary, may include other components.

The thermosensitive adhesive layer contains a thermoplastic resin and a thermofusion compound, and may further contain a tackifier, if necessary. The thermoplastic resin provides adhesion and bonding force. The thermofusion compound does not provide plasticity to the resin at normal temperature, as it is in a solid state at normal temperature, but it fuses by an application of heat and makes the resin swollen or softened to exhibit adhesion. Moreover, the tackifier functions to improve the adhesion.

A thermosensitive recording magnetic paper, which is another embodiment of the thermosensitive recording material of the present invention, contains a magnetic recording layer on a back surface of the base or the back layer of the thermosensitive recording material, and may further contain other components.

The magnetic recording layer is formed on the support either by coating method using iron oxide and barium ferrite or the like together with vinyl chloride resin, urethane resin, nylon resin or the like, or by vapor deposition or sputtering without using resins.

The magnetic recording layer is preferably disposed on the surface of the base opposite to the surface thereof where the thermosensitive recording layer is disposed, but may be disposed between the base and the thermosensitive recording layer, or on part of the thermosensitive recording layer.

The shape of the thermosensitive recording material is selected depending on the intended purpose, but is preferably in the shape of a label, sheet, roll, or the like.

A thermosensitive recording label, which does not require a release paper, can be obtained by applying a thermosensitive adhesive, which exhibits adhesion by an application of heat, on a back surface of the thermosensitive recording material of the present invention. As a result, the thermosensitive recording material can be used for POS labels, or labels used for physical distribution, and thus a range of applications thereof increases. Moreover, since this label does not require a release paper, a more environmentally friendly label can be attained.

Recording performed on the thermosensitive recording material of the present invention can be performed by heating with a thermal pen, a thermal head, leaser or the like depending on the purpose for use, without any restriction.

The thermosensitive recording material of the present invention can be suitably used for in the various fields, including: POS such as for perishable foods, packed lunch, and prepared foods; copying such as for copying books and documents; telecommunication such as facsimile; tickets such as ticket vendors, and receipts; and tags for packages in the airline industry.

According to the present invention, there can be provided a thermosensitive recording material, which can be obtained by high-speed coating, is highly sensitive, and is excellent in storage stability, printability, and head-matching properties.

EXAMPLES

Examples of the present invention will be explained hereinafter, but these examples shall not be construed as limiting the scope of the present invention in any way. Moreover, in Examples, "part(s)," "%," and "ratio" are all mass basis such as "part(s) by mass," "% by mass," and "mass ratio", unless otherwise stated.

Example 1

1. Preparation of Undercoat Layer Coating Liquid

| [Liquid A (undercoat layer coating liquid)] | |
|---|---|
| Hollow plastic spherical particles (copolymer resin mainly formed of styrene-acrylic acid copolymer, product name: ROPAQUE HP-91, manufacturer: Rohm and Haas Company, solid content: 27.5%, number average particle diameter: 1 μm, void ratio: 50%) | 36 parts |
| Styrene-butadiene copolymer latex (product name: SMARTEX PA-9159, manufacturer: Nippon A & L Inc., solid content: 47.5%) | 10 parts |
| Water | 54 parts |

2. Preparation of Thermosensitive Coloring Layer Coating Liquid

| [Liquid B (leuco dye dispersion liquid)] | |
|---|---|
| 2-anilino-3-methyl-6-(di-n-butylamino)fluoran (leuco dye) | 20 parts |
| 10% itaconic acid-modified polyvinyl alcohol (modification ratio: 1 mol %)(product name: KL-318, manufacturer: Kuraray Co., Ltd., molecular weight: about 80,000) solution | 20 parts |
| Water | 60 parts |

| [Liquid C (color developer dispersion liquid)] | |
|---|---|
| 4-hydroxy-4'-isopropoxydiphenyl sulfone (color developer)(product name: D-8, manufacturer: Nippon Soda Co., Ltd.) | 20 parts |
| 10% itaconic acid-modified polyvinyl alcohol (modification ratio: 1 mol %)(product name: KL-318, manufacturer: Kuraray Co., Ltd., molecular weight: about 80,000) solution | 20 parts |
| Silica (product name: MIZUKASIL P-527, manufacturer: Mizusawa Industrial Chemicals, Ltd.) | 10 parts |
| Water | 50 parts |

Liquid B and Liquid C each having the aforementioned formulation were each separately dispersed by means of a sand mill to have a number average particle diameter of 1.0 μm or less, to obtain a dye dispersion liquid [Liquid B], and a color developer dispersion liquid [Liquid C], respectively.

Next, Liquid B and Liquid C were mixed together in the ratio of 1:7 so as to adjust the solid content to be 25%, and then the mixture was stirred to obtain a thermosensitive coloring layer coating layer [Liquid D].

3. Preparation of Protective Layer Coating Liquid

| [Liquid E] | |
|---|---|
| Aluminum hydroxide (filler) (number average particle diameter: 0.6 μm, product name: HIGILITE H-43M, manufacturer: Showa Denko K.K.) | 20 parts |
| 10% itaconic acid-modified polyvinyl alcohol (modification ratio: 1 mol %)(product name: KL-318, manufacturer: Kuraray Co., Ltd., molecular weight: about 80,000) solution | 20 parts |
| Water | 60 parts |

The material of the aforementioned formulation was dispersed by means of a sand mill for 24 hours to thereby prepare Liquid E.

| [Liquid F] | |
|---|---|
| Liquid E | 75 parts |
| 10% diacetone-modified polyvinyl alcohol (modification ratio: 4 mol %)(product name: DM-17, manufacturer: Japan Vam & Poval Co., Ltd., molecular weight: 80,000 to 90,000)(resin) solution | 100 parts |
| 10% adipic dihydrazide (crosslinking agent)(product name: ADH, manufacturer: JAPAN FINECHEM COMPANY, INC.) solution | 10 parts |
| Wax Emulsion 1 (product name: RP-960, manufacturer: Chukyo Yushi Co., Ltd., solid content: 30%) shown in Table 1 | 20 parts |
| Water | 90 parts |

The materials of the aforementioned formulation were mixed and dispersed to prepare a protective layer coating liquid [Liquid F].

Emulsification dispersions of Polyethylene Wax Emulsions 1 to 10 were each performed using polyethylene wax and an emulsifying agent. An acid value and number average particle diameter of each polyethylene wax used, and each emulsifying agent used were as shown in Table 1.

TABLE 1

| | Acid value of wax (mgKOH/g) | Particle diameter (μm) | Emulsifying agent |
|---|---|---|---|
| Wax Emulsion 1 | 15 | 0.5 | Anionic emulsifying agent |
| Wax Emulsion 2 | 30 | 0.5 | Anionic emulsifying agent |
| Wax Emulsion 3 | 10 | 0.5 | Anionic emulsifying agent |
| Wax Emulsion 4 | 15 | 2.0 | Anionic emulsifying agent |
| Wax Emulsion 5 | 15 | 0.3 | Anionic emulsifying agent |
| Wax Emulsion 6 | 15 | 0.1 | Nonionic emulsifying agent |
| Wax Emulsion 7 | 0 | 0.4 | Nonionic emulsifying agent |
| Wax Emulsion 8 | 5 | 0.8 | Anionic emulsifying agent |
| Wax Emulsion 9 | 17 | 0.1 | Anionic emulsifying agent |
| Wax Emulsion 10 | 15 | 3.0 | Anionic emulsifying agent |

Moreover, acid values, and particle diameters of polyethylene wax in Table 1 were measured in the following manners, respectively.

<Measuring Method of Acid Value>

The acid value of the wax was measured in accordance with a method specified in JIS K 2501.

<Measuring Method of Number Average Particle Diameter>

As the particle diameter, a number average particle diameter of dispersed particles was measured by means of a laser diffraction particle size analyzer (product name: LA-920, manufacturer: Horiba, Ltd.)

4. Preparation of Thermosensitive Recording Paper

Liquid A was applied to a surface of a paper base (high quality paper having a basis weight of 60 g/m$^2$) so as to have a deposition amount of 3.0 g/m$^2$ on dry basis, and dried to thereby form an under layer.

Onto the under layer, the thermosensitive coloring layer coating liquid [Liquid D] was applied so as to have a deposition amount of 4.0 g/m$^2$ on dry basis, and dried to thereby form a thermosensitive coloring layer. Thereafter, the protective layer coating liquid [Liquid F] was applied onto the thermosensitive coloring layer so as to have a deposition amount of 3.0 g/m$^2$ on dry basis, and dried to thereby form a protective layer.

Thereafter, calendaring was performed so that the surface had Oken-type smoothness of about 2,000 seconds, to thereby prepare a thermosensitive recording material of Example 1.

Example 2

A thermosensitive recording material of Example 2 was prepared in the same manner as in Example 1, provided that 20 parts of Oxidized Polyethylene Wax Emulsion 1 used in the protective layer coating liquid [Liquid F] was replaced with 20 parts of Oxidized Polyethylene Wax Emulsion 2 in Table 1.

Example 3

A thermosensitive recording material of Example 3 was prepared in the same manner as in Example 1, provided that 20 parts of Oxidized Polyethylene Wax Emulsion 1 used in the protective layer coating liquid [Liquid F] was replaced with 20 parts of Oxidized Polyethylene Wax Emulsion 3 shown in Table 1.

Example 4

A thermosensitive recording material of Example 4 was prepared in the same manner as in Example 1, provided that 20 parts of Oxidized Polyethylene Wax Emulsion 1 used in the protective layer coating liquid [Liquid F] was replaced with 20 parts of Oxidized Polyethylene Wax Emulsion 4 shown in Table 1.

Example 5

A thermosensitive recording material of Example 5 was prepared in the same manner as in Example 1, provided that 20 parts of Oxidized Polyethylene Wax Emulsion 1 used in the protective layer coating liquid [Liquid F] was replaced with 20 parts of Oxidized Polyethylene Wax Emulsion 5 shown in Table 1.

Example 6

A thermosensitive recording material of Example 6 was prepared in the same manner as in Example 1, provided that 20 parts of Oxidized Polyethylene Wax Emulsion 1 used in the protective layer coating liquid [Liquid F] was replaced with 5 parts of Oxidized Polyethylene Wax Emulsion 1 shown in Table 1.

Example 7

A thermosensitive recording material of Example 7 was prepared in the same manner as in Example 1, provided that 20 parts of Oxidized Polyethylene Wax Emulsion 1 used in the protective layer coating liquid [Liquid F] was replaced with 100 parts of Oxidized Polyethylene Wax Emulsion 1 shown in Table 1.

Example 8

A thermosensitive recording material of Example 8 was prepared in the same manner as in Example 1, provided that 30 parts of the following [Liquid G] was further added to the protective layer coating liquid [Liquid F].

| [Liquid G] | |
|---|---|
| Spherical silicone particles having a volume average particle diameter of 2.0 μm (product name: KMP-590, manufacturer: ShinEtsu Chemical Co., Ltd.) | 30 parts |
| Water | 60 parts |

The materials of the aforementioned formulation were stirred by a stirrer for 1 hour, to thereby prepare Liquid G.

Example 9

A thermosensitive recording material of Example 9 was prepared in the same manner as in Example 1, provided that an intermediate layer coating liquid [Liquid H] was prepared in the manner mentioned below, and an intermediate protective layer was formed.

| [Liquid H] | |
|---|---|
| 10% diacetone-modified polyvinyl alcohol (modification ratio: 4 mol %) (product name: DM-17, manufacturer: Japan Vam & Poval Co., Ltd.) solution | 100 parts |
| 10% adipic dihydrazide (product name: ADH, manufacturer: JAPAN FINECHEM COMPANY, INC.) | 10 parts |
| Water | 90 parts |

The materials of the aforementioned formulation were mixed and stirred, to thereby prepare an intermediate protective layer coating liquid [Liquid H].

Preparation of Thermosensitive Recording Material

Liquid A was applied to a surface of a paper base (high quality paper having a basis weight of about 60 g/m$^2$) so as to have a deposition amount of 3.0 g/m$^2$ on dry basis, and dried to thereby form an under layer.

Onto the under layer, the thermosensitive coloring layer coating liquid [Liquid D], intermediate protective layer coating liquid [Liquid H], and protective layer coating liquid [Liquid F] were simultaneously applied by a curtain coater at 600 m/min. so as to have deposition amounts of 4.0 g/m$^2$, 1.0 g/m$^2$, and 1.0 g/m$^2$, respectively, and dried. Thereafter, calendaring was performed so that the surface thereof have Oken-type smoothness of about 2,000 seconds, to thereby prepare a thermosensitive recording material of Example 9.

Example 10

A thermosensitive recording material of Example 10 was prepared in the same manner as in Example 9, provided that 37 parts of 27% styrene-acryl copolymer [acid value: 230 mgKOH/g] (product name: JDA-6180, manufacturer: BASF Japan Ltd.) was further added to the intermediate protective layer coating liquid [Liquid E].

Example 11

A thermosensitive recording material of Example 11 was prepared in the same manner as in Example 1, provided that 20 parts of Oxidized Polyethylene Wax Emulsion 1 used in the protective layer coating liquid was replaced with 20 parts of Oxidized Polyethylene Wax Emulsion 6 (product name: L-787, manufacturer: Chukyo Yushi Co., Ltd.).

Comparative Example 1

A thermosensitive recording material of Comparative Example 1 was prepared in the same manner as in Example 1, provided that 20 parts of Oxidized Polyethylene Wax Emulsion 1 used in the protective layer coating liquid was replaced with 20 parts of Unoxidized Polyethylene Wax Emulsion 7 (product name: DP-2401, manufacturer: Tokyo ADL Corporation).

Example 12

A thermosensitive recording material of Example 12 was prepared in the same manner as in Example 1, provided that 20 parts of Oxidized Polyethylene Wax Emulsion 1 used in the protective layer coating liquid was replaced with 20 parts of Oxidized Polyethylene Wax Emulsion 8.

Example 13

A thermosensitive recording material of Example 13 was prepared in the same manner as in Example 1, provided that 20 parts of Oxidized Polyethylene Wax Emulsion 1 used in the protective layer coating liquid was replaced with 20 parts of Oxidized Polyethylene Wax Emulsion 9 (product name: Nopcote PEM-17, manufacturer: San Nopco Limited).

Example 14

A thermosensitive recording material of Example 14 was prepared in the same manner as in Example 1, provided that 20 parts of Oxidized Polyethylene Wax Emulsion 1 used in the protective layer coating liquid was replaced with 20 parts of Oxidized Polyethylene Wax Emulsion 10.

Example 15

A thermosensitive recording material of Example 15 was prepared in Example 1, provided that an amount of Oxidized Polyethylene Wax Emulsion 1 used in the protective layer coating liquid was changed from 20 parts to 3 parts.

Example 16

A thermosensitive recording material of Example 16 was prepared in Example 1, provided that an amount of Oxidized Polyethylene Wax Emulsion 1 used in the protective layer coating liquid was changed from 20 parts to 120 parts.

Comparative Example 2

A thermosensitive recording material of Comparative Example 2 was prepared in the same manner as in Example 1, provided that 20 parts of Oxidized Polyethylene Wax Emulsion 1 used in the protective layer coating liquid was replaced with 20 parts of 30% montanic acid ester wax (product name: J-206, manufacturer: Chukyo Yushi Co., Ltd.) dispersion liquid.

Comparative Example 3

A thermosensitive recording material of Comparative Example 3 was prepared in the same manner as in Example 1, provided that 20 parts of Oxidized Polyethylene Wax Emulsion 1 used in the protective layer coating liquid was replaced with 20 parts of 31.5% zinc stearate (product name: Hydrin Z-7-30, manufacturer: Chukyo Yushi Co., Ltd.) dispersion liquid.

Comparative Example 4

A thermosensitive recording material of Comparative Example 4 was prepared in the same manner as in Example 1, provided that the protective layer coating liquid [Liquid F] was replaced with the following protective layer coating liquid [Liquid I].

| [Liquid I] | |
|---|---|
| Liquid E | 75 parts |
| 10% itaconic acid-modified polyvinyl alcohol (modification ratio: 1 mol %) (production name: KL-318, manufacturer: Kuraray Co., Ltd., molecular weight: about 80,000) | 100 parts |
| Polyamide epichlorohydrin resin (product name: WS525, manufacturer: Seiko PMC Corporation) | 30 parts |
| Oxidized Polyethylene Wax Emulsion 1 | 20 parts |
| Water | 90 parts |

The materials of the aforementioned formulation were mixed and stirred to thereby prepare a protective layer coating liquid [Liquid I].

Example 17

A thermosensitive recording material of Example 17 was prepared in the same manner as in Example 1, provided that the protective layer coating liquid [Liquid F] was replaced with the following protective layer coating liquid [Liquid J].

| [Liquid J] | |
|---|---|
| Liquid E | 75 parts |
| 10% diacetone-modified polyvinyl alcohol (modification ratio: 4 mol %)(product name: DM-17, manufacturer: Japan Vam & Poval Co., Ltd., molecular weight: 80,000 to 90,000)(resin) solution | 100 parts |
| 10% adipic dihydrazide (crosslinking agent)(product name: ADH, manufacturer: JAPAN FINECHEM COMPANY, INC.) solution | 10 parts |
| Dispersion Liquid A described below | 40 parts |
| Water | 60 parts |
| <Preparation of Dispersion Liquid A> | |
| Oxidized polyethylene wax (product name: LICOLUB H12, manufacturer: Clariant Japan K.K., melting point: 105° C., average molecular weight: 1,000, acid value: 17 mgKOH/g) | 12 parts |
| 30% vinyl alcohol-sodium allylsulfonate copolymer (product name: GOHSERAN L-3266, manufacturer: Nippon Synthetic Chemical Industry Co., Ltd., molecular weight: about 15,000) solution | 4 parts |
| 10% alkyl sulfonate (product name: Newcol 290M, manufacturer: Nippon Nyukazai Co., Ltd.) solution | 1 part |
| Water | 80 parts |

The mixed solution prepared by mixing the materials of the aforementioned formulation was dispersed by means of a sand mill until the number average particle diameter of the oxidized polyethylene wax became 0.5 μm, to thereby prepare Dispersion Liquid A.

The thermosensitive recording materials obtained in Examples and Comparative Examples above were each subjected to the evaluations in terms of "sticking under low temperature and low humidity environment," "plasticizer resistance," "water resistance," "conveying performance in high temperature and high humidity environment," "measurement of coloring sensitivity magnification," and "water resistance of aqueous flexo print". The results are shown in Table 2.

1. Evaluation on Sticking Under Low Temperature and Low Humidity Environment (Evaluation on Head Matching)

<Evaluation Method>

Each thermosensitive recording material and a printer (product name: L' esprit R-12, manufacturer: Sato Corporation) were left to stand in the low temperature (5° C.) and low humidity (30% RH) environment for 1 hour for moisture conditioning, and then printing was performed using the thermosensitive recording material and the printer. A printing length was a length of a print from the starting portion of the print where a certain printing pattern was started to print by the printer to an ending portion of the print. When the thermosensitive recording material has an excellent anti-sticking property, the printing pattern is printed accurately. On the other hand, when the thermosensitive recording material has a poor anti-sticking property, the patterns are printed so as to be superimposed on the same portion of the thermosensitive recording material, and thus the printing pattern is not printed accurately. Moreover, quality of the resulting print was confirmed visually, and the evaluation of sticking was performed based on the following criteria.

<Evaluation Criteria>

5: No sticking occurred.

4: Sticking occurred, but there was no problem in the quality of the print.

3: Sticking occurred, and there was a problem in the quality of the print.

2: The thermosensitive recording material could not be perfectly conveyed, and sticking occurred.

1: The thermosensitive recording material could not be conveyed at all.

Note that, 4 and 5 are levels sufficient enough to commercial use.

2. Evaluation on Plasticizer Resistance

Each thermosensitive recording material was subjected to printing using a printing simulator manufactured by Okura Denki Co., Ltd. at the energy of 1.00 ms to prepare a test sample. On a surface of the test sample, a polyvinyl chloride film containing a plasticizer was laminated, and left to stand for 24 hours at 40° C. Then, density of the imaging part was measured by Macbeth Densitometer RD-914.

3. Evaluation on Water Resistance

Each thermosensitive recording material was subjected to printing using a printing simulator manufactured by Okura Denki Co., Ltd. at the energy of 1.00 ms to prepare a test sample. The test sample was immersed in 100 mL of water in the environment having the temperature of 20° C. for 24 hours, and then density of the imaging part was measured by Macbeth Densitometer RD-914.

4. Evaluation on Conveyance in High Temperature and High Humidity Environment

Each thermosensitive recording material and a printer (product name: SM-90, manufacturer: Teraokaseiko Co., Ltd.) were left to stand in the high temperature (40° C.) and high humidity (90% RH) environment for 1 hour for moisture conditioning, and then printing was performed using the thermosensitive recording material and the printer. A printing length was a length of a print from the starting portion of the print where a certain printing pattern was started to print by the printer to an ending portion of the print. When the thermosensitive recording material has an excellent conveying performance, the printing pattern is printed accurately, and the length of the printing pattern matches to a length of the resulting print on the sample. On the other hand, when the thermosensitive recording material has a poor conveyance performance, conveyance failures may occur due to sticking occurred between the thermosensitive recording material and a thermal head. As a result, the printing portion is printed so as to be shorter than the actual printing portion, and meandering of the thermosensitive recording material occurs during conveyance thereof. Therefore, the printing length of the resulting print is shorter than the printing length of the printing pattern.

In the test, a printing pattern having a printing length of 100 mm was used.

after, one droplet of water was dripped on the printed image. Five minutes later, the image was strongly rubbed with a finger once, and water resistance of the flexo print was determined based on the peeling degree of the printed image.

The evaluation criteria of the pealing test for determining water resistance of the aqueous flexo print was as follows.

A: There was no peeling in the printed portion.

B: Less than 25% of the printed portion was peeled.

C: 25% or more but less than 50% of the printed portion was peeled.

D: 50% or more of the printed portion was peeled.

TABLE 2

| | Head matching | Plasticizer resistance | Water resistance | Conveyance in high temp/ high RH | Coloring sensitivity magnification | Water resistance evaluation of aqueous flexo print |
|---|---|---|---|---|---|---|
| Ex. 1 | 5 | 1.21 | 1.20 | 98 | 1.00 | B |
| Ex. 2 | 5 | 1.20 | 1.21 | 98 | 1.01 | B |
| Ex. 3 | 4 | 1.20 | 1.20 | 98 | 1.00 | B |
| Ex. 4 | 5 | 1.18 | 1.21 | 98 | 1.00 | B |
| Ex. 5 | 5 | 1.22 | 1.20 | 98 | 0.99 | B |
| Ex. 6 | 4 | 1.23 | 1.21 | 98 | 1.00 | B |
| Ex. 7 | 5 | 1.16 | 1.20 | 100 | 1.01 | B |
| Ex. 8 | 5 | 1.20 | 1.20 | 100 | 1.01 | B |
| Ex. 9 | 5 | 1.23 | 1.22 | 98 | 1.05 | B |
| Ex. 10 | 5 | 1.23 | 1.21 | 98 | 1.05 | A |
| Ex. 11 | 4 | 1.19 | 1.07 | 98 | 1.01 | B |
| Comp. Ex. 1 | 1 | 1.05 | 1.05 | 30 | 0.99 | B |
| Ex. 12 | 4 | 1.21 | 1.20 | 80 | 0.99 | B |
| Ex. 13 | 4 | 1.21 | 1.21 | 98 | 0.99 | B |
| Ex. 14 | 5 | 1.08 | 1.19 | 98 | 1.00 | B |
| Ex. 15 | 4 | 1.22 | 1.20 | 80 | 1.00 | B |
| Ex. 16 | 5 | 1.06 | 1.19 | 100 | 1.01 | B |
| Comp. Ex. 2 | 5 | 0.89 | 1.19 | 98 | 0.99 | B |
| Comp. Ex. 3 | 5 | 0.61 | 1.20 | 98 | 1.01 | B |
| Comp. Ex. 4 | 5 | 1.22 | 1.19 | 32 | 1.00 | A |
| Ex. 17 | 5 | 1.19 | 1.19 | 98 | 1.00 | B |

5. Measurement of Coloring Sensitivity Magnification

Each thermosensitive recording material was subjected to printing by means of a thermosensitive print testing device having a thin film head manufactured by Panasonic Electronic Device Co., Ltd. at the head power of 0.45 W/dot, 1-line recording duration of 20 msec/L, and scanning density of 8×385 dot/mm per milli second with pulse width of 0.2 msec to 1.2 msec. The density of the resulting print was measured by Macbeth Densitometer RD-914, and the pulse width provided the printed pattern having the density of 1.0 was calculated.

Using Example 1 as a standard, the sensitivity magnification was calculated by the following formula. The larger the value is, more excellent sensitivity (thermal response) is.

Sensitivity magnification=(pulse width of Example 1)/(pulse width of measured sample)

6. Evaluation on Water Resistance of Aqueous Flexo Print

Onto each thermosensitive recording material, an aqueous flexo ink (product name: MTQ 30302-404, manufacturer: AkzoNobel) which had been diluted to 25% was applied by a wire bar having a line diameter of 0.10 mm, and was left to stand for 1 hour in the environment having the temperature of 23° C. and humidity of 50% RH so as to dry the ink. There-

What is claimed is:

1. A thermosensitive recording material, comprising:

a base;

a thermosensitive coloring layer containing a leuco dye and a color developer;

at least one protective layer containing a resin, a crosslinking agent, and wax, wherein the thermosensitive coloring layer is disposed on the base, and the protective layer is disposed on the thermosensitive coloring layer, and wherein the resin is reactive carbonyl group-containing polyvinyl alcohol, the crosslinking agent is a hydrazide compound, and the wax is oxidized polyethylene wax.

2. The thermosensitive recording material according to claim 1, wherein the protective layer is formed using a protective layer composite liquid, which is a wax emulsion in which the oxidized polyethylene wax is emulsified and dispersed with assistance of an anionic emulsifying agent.

3. The thermosensitive recording material according to claim 2, wherein the oxidized polyethylene wax has an acid value of 10 mgKOH/g to 30 mgKOH/g.

4. The thermosensitive recording material according to claim 2, wherein the oxidized polyethylene wax in the protective layer has a number average particle diameter of 0.3 μm to 2.0 μm.

5. The thermosensitive recording material according to claim 1, wherein the oxidized polyethylene wax is contained in the protective layer in an amount of 5 parts by mass to 100 parts by mass relative to 100 parts by mass of the resin in the protective layer.

6. The thermosensitive recording material according to claim 1, wherein the protective layer further comprises silicone resin particles.

7. The thermosensitive recording material according to claim 1, further comprising:

an intermediate protective layer disposed between the thermosensitive coloring layer and the protective layer, wherein the thermosensitive coloring layer, the intermediate protective layer, and the protective layer are formed by simultaneously coating the layers by a curtain coating method.

8. The thermosensitive recording material according to claim 7, wherein the intermediate protective layer contains a (meth)acrylic resin.

* * * * *